United States Patent [19]

Nomura et al.

[11] Patent Number: 4,676,179

[45] Date of Patent: Jun. 30, 1987

[54] PRESSER DEVICE FOR SEWING MACHINE

[75] Inventors: Etsuzo Nomura; Tetsuo Kozawa; Yasuo Sakakibara, all of Nagoya, Japan

[73] Assignee: Brother Kogyo Kabushiki Kaisha, Nagoya, Japan

[21] Appl. No.: 925,183

[22] Filed: Oct. 31, 1986

[30] Foreign Application Priority Data

Nov. 5, 1985 [JP] Japan ..... 60-247639

[51] Int. Cl.[4] ..... D05B 69/18; D05B 69/24; D05B 29/02

[52] U.S. Cl. ..... 112/239; 112/275

[58] Field of Search ..... 112/275, 239, 220; 318/551

[56] References Cited

U.S. PATENT DOCUMENTS

| | | | |
|---|---|---|---|
| 3,585,950 | 6/1971 | Ito | 112/239 X |
| 3,721,204 | 3/1973 | Schaffer et al. | 112/239 X |
| 4,517,909 | 5/1985 | Neki et al. | 112/275 |
| 4,538,533 | 9/1985 | Ohchi et al. | 112/239 |

FOREIGN PATENT DOCUMENTS

| | | | |
|---|---|---|---|
| 47-15381 | 5/1972 | Japan . | |
| 55-4434 | 1/1980 | Japan | 112/239 |
| 57-30034 | 6/1982 | Japan . | |

*Primary Examiner*—Werner H. Schroeder
*Assistant Examiner*—Andrew M. Falik
*Attorney, Agent, or Firm*—Jordan and Hamburg

[57] ABSTRACT

A presser device for a sewing machine, comprising: pressing means reciprocally movable between a holding position in which it presses and holds a workpiece and a releasing position in which it is spaced the farthest from the workpiece; drive means for driving the pressing means; means for controlling the drive means so that the pressing means is brought into the holding means before the start of the sewing operation of the sewing machine; means for controlling the drive means so that the pressing means is brought from the holding position to the releasing position after the end of the sewing operation; timer means for setting a predetermined time from the instant when the pressing means is brought into the releasing position; and means for controlling the drive means so that the pressing means is brought from said releasing position to an optional intermediate position between the releasing position and the holding position after lapse of the predetermined time.

5 Claims, 6 Drawing Figures

PRESSER DEVICE FOR SEWING MACHINE

BACKGROUND OF THE INVENTION

1. Field of the Invention

The present invention relates to a presser device for a sewing machine, which is constructed such that pressing means for pressing and holding workpiece can be automatically brought to a holding position, a releasing position and an intermediate position by the action of drive means.

2. Description of the Prior Art

In Japanese Patent Publication No. 30034/1982 (or Application No. 32766/1975), there is disclosed a presser device for a sewing machine, which is constructed such that a solenoid is energized to bring a presser foot to a releasing position after the end of a sewing operation and is then deenergized to move the presser foot from the releasing position to a holding position when a time required for detaching the workpiece has elapsed. According to this construction, however, the presser foot is arranged only in the releasing position or the holding position but not in any intermediate positions. This is accompanied by a difficulty in positioning the workpiece for a next sewing operation.

In another Japanese Patent Publication No. 15381/1972 (or Application No. 766/1969), there is disclosed a presser device for a sewing machine, which is constructed such that a solenoid can be energized at a predetermined voltage level on the basis of the manual operation of a foot pedal to arrange pressing means in an intermediate position between a holding position and a releasing position thereby to facilitate exactly positioning of the workpiece. In order to effect this arrangement, according to this construction, however, it is necessary to adjust the depression of a foot pedal to a proper level so that the predetermined voltage level may be attained. This raises a problem that a heavy burden is imposed upon the worker who has to continuously sew a numerous sheets of workpiece.

SUMMARY OF THE INVENTION

An object of the present invention is to provide a presser device for a sewing machine, constructed such that pressing means can be automatically moved at the end of a sewing operation to a position, in which it releases workpiece, thereby to facilitate exchange of the workpiece and to an optional intermediate position between the releasing position and a holding position after lapse of a predetermined time from the instant when the pressing means is arranged in the releasing position, thereby to facilitate positioning of the workpiece for the next sewing operation without any requirement for the manual operation of a foot pedal or the like.

Another object of the present invention is to provide a presser device for a sewing machine, which can adjust the aforementioned intermediate position of the pressing means suitably in a vertical direction in accordance with the thickness of the workpiece.

Still another object of the present invention is to provide a presser device for a sewing machine, which can change an operating speed at will.

A further object of the present invention is to provide a presser device for a sewing machine, which can ensure operations of a mechanism for moving the pressing means with a simple construction having a reduced number of parts.

In order to achieve the above-specified objects, according to a first aspect of the present invention, there is provided a presser device for a sewing machine, comprising: pressing means reciprocally movable between a holding position in which it presses and holds a workpiece and a releasing position in which it is spaced the farthest from said workpiece; drive means for driving said pressing means; means for controlling said drive means so that said pressing means may be brought into said holding position before the start of a sewing operation of said sewing machine; means for controlling said drive means so that said pressing means may be brought from said holding position to said releasing position after the end of said sewing operation; timer means for setting a predetermined time from the instant when said pressing means is brought into said releasing position; and means for controlling said drive means so that said pressing means is brought from said releasing position to an optional intermediate position between said releasing position and said holding position after lapse of said predetermined time.

According to a second aspect of the present invention, there is provided a presser device for a sewing machine, which can adjust the intermediate position of the pressing means.

According to a third aspect of the present invention, there is provided a presser device for a sewing machine, which can optionally change the time set by the timer means.

According to a fourth aspect of the present invention, there is provided a presser device for a sewing machine, which further comprises: said drive means including a servo solenoid and linkage means provided between said servo solenoid and pressing means.

The objects of the present invention other than the aforementioned ones will become apparent if an embodiment to be described hereinafter is understood, as clearly defined in the accompanying claims. And, numerous advantages left untouched herein will occur to those skilled in the art if the present invention is put into practice.

DESCRIPTION OF THE PREFERRED EMBODIMENT

One embodiment of the present invention will be described in detail in the following with reference to the accompanying drawings.

Figure 1:
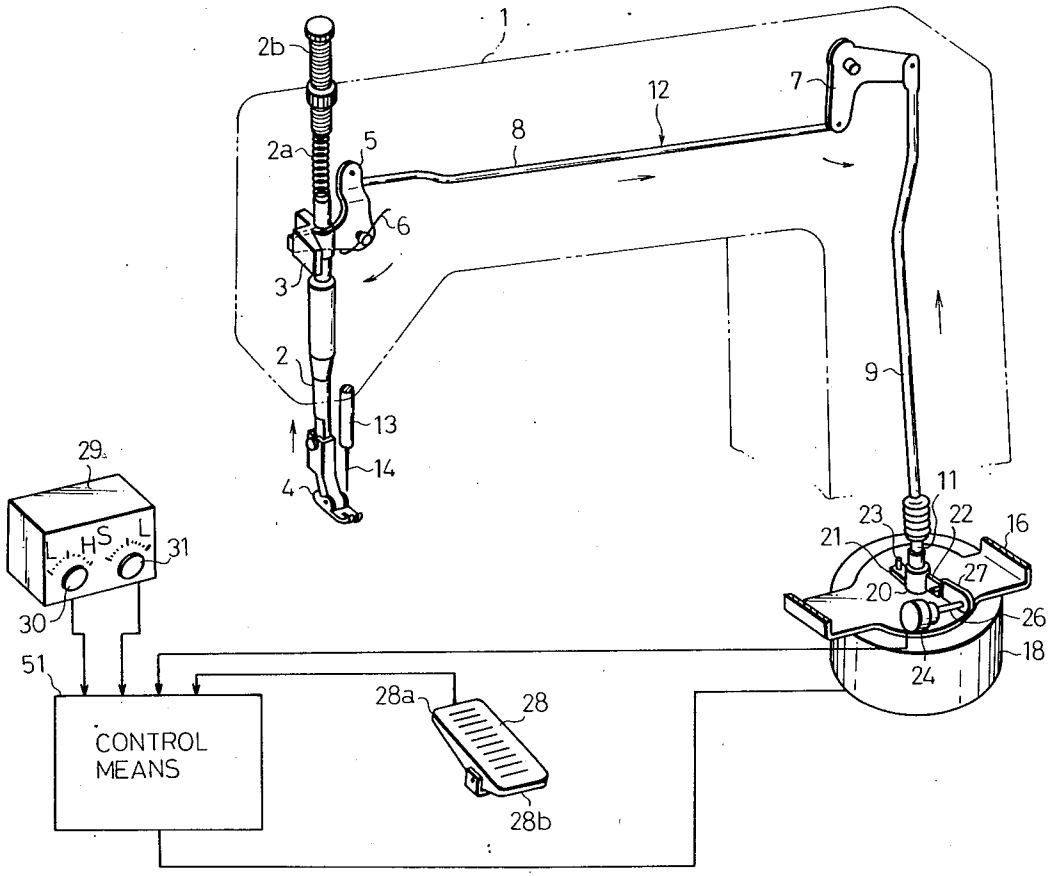
FIG. 1 is a perspective view showing a presser device for a sewing machine according to one embodiment of the present invention.

Now, in the sewing machine of the present embodiment, as shown in FIG. 1, there is vertically movably supported in the head of a machine frame 1 a presser bar 2 having its upper end attached thereto a bar connecting stud 3 and its lower end mounting thereon a presser foot 4 as a pressing means. A presser spring 2*a* is arranged on the presser bar 2 so that a pressing pressure is applied to work fabric or the like through the presser foot 4 by a spring force which is adjusted and set by an adjusting screw 2*b*. In the vicinity of the bar connecting stud 3, there is rotatably supported in the machine frame 1 a first rotary lever 5 which is rotationally biased in a direction to engage with the bar connecting stud 3 by the action of a spring 6. In a manner to correspond to the first rotary lever 5, there is also rotatably supported in the machine frame 1 a second rotary lever 7 which has its one arm portion connecting a connecting rod 8 between itself and the first rotary lever 5 and its other arm portion connecting thereto an actuating rod 9.

Figure 2:
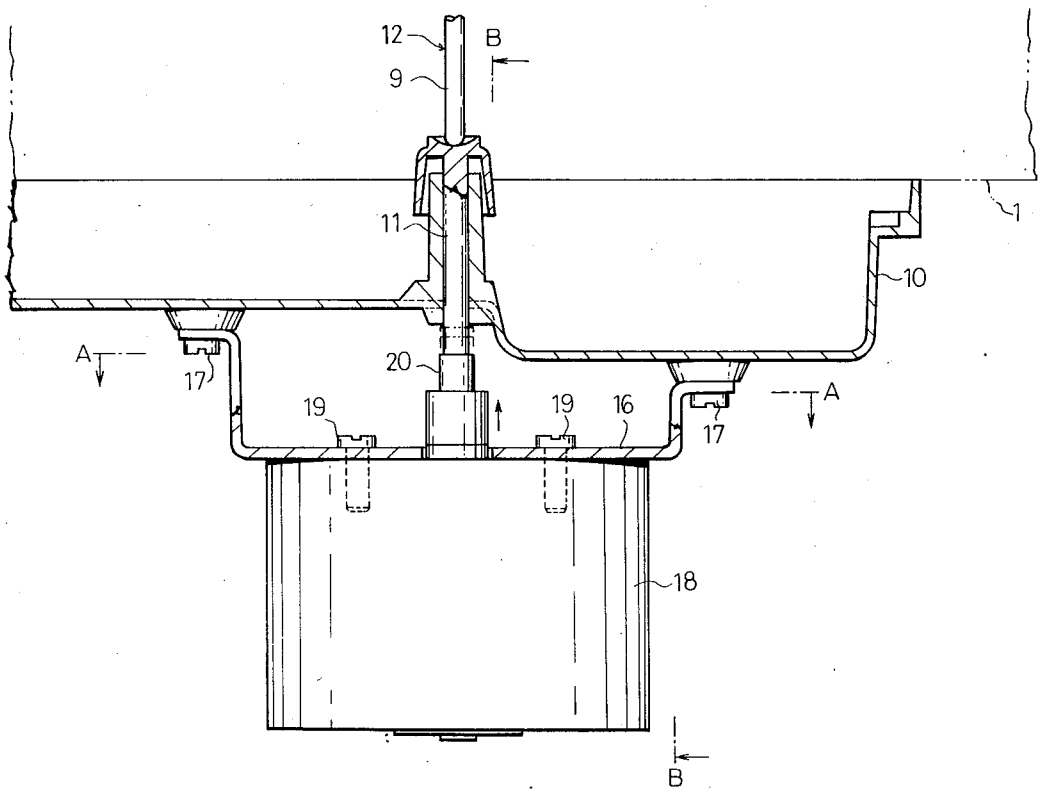
FIG. 2 is a partially sectional view showing a supporting structure of a servo solenoid acting as drive means in an enlarged scale.
Figure 3:
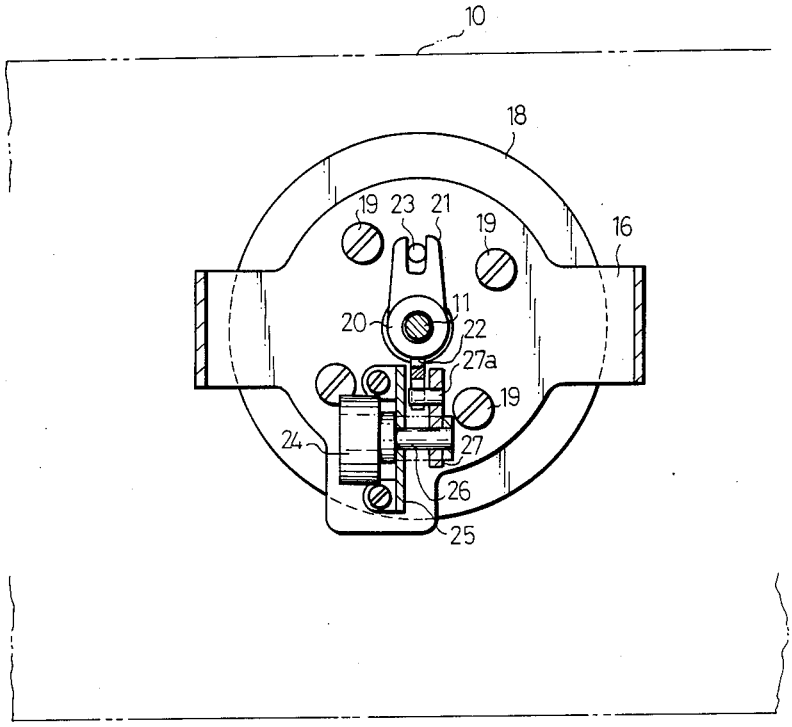
FIG. 3 is a partially sectional view taken along line A—A of FIG. 2.
Figure 4:
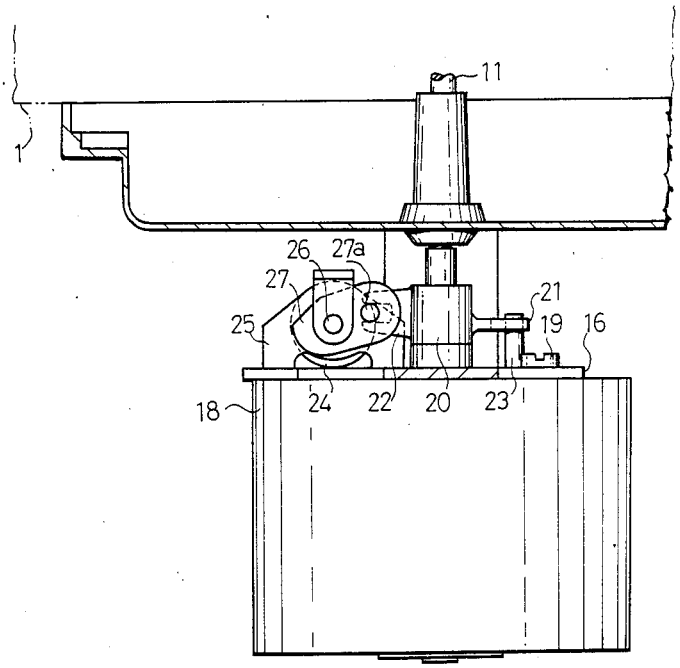
FIG. 4 is a partially sectional view taken along line B—B of FIG. 2.

In an oil pan 10 disposed below the aforementioned machine frame 1, as shown in FIGS. 1 and 2, there is supported a generally rod-shaped associative member 11 which extends therethrough such that it can linearly move between two upper and lower positions corresponding to the raised position and lower position of the presser foot 4 and such that its upper end is engaged by the lower end of the aforementioned actuating rod 9. The aforementioned first rotary lever 5, connecting rod 8, second rotary lever 7, actuating rod 9 and the associative member 11 constitute together an linkage means 12 such that the presser bar 2 and the presser foot 4 are raised, when the associative member 11 of the linkage means 12 is moved upward, through the remaining members of the linkage means 12 and the bar connecting stud 3.

As shown in FIG. 1, a needle bar 13 is supported vertically movably on the head of the machine frame 1 in front of the aforementioned presser bar 2 such that a needle 14 is attached to the lower end of the needle bar 13. When, moreover, a not-shown main shaft is rotated on the basis of the start of a motor 15 (See FIG. 5) disposed below the machine frame 1, said needle 14 is moved up and down so that seams are formed in work fabric or the like placed on a bed by the coaction between the needle 14 and a not-shown loop taker disposed in the bed of the machine frame 1.

As shown in FIGS. 1 to 4, a bracket 16 is fastened to the lower face of the oil pan 10 in the vicinity of the lower end of said associative member 11 by means of screws 17. At the lower face of the support bracket 16, there is fastened by means of a plurality of screws 19 a servo solenoid 18 forming drive means, from the center of whose upper face there is projected in an extending manner through the support bracket 16 an armature 20 acting as an actuator. And, the lower end face of the aforementioned associative member 11 is held in abutment against the upper end face of the aforementioned armature 20 to keep the associative member 11 and the armature 20 in direct engagement with each other.

On the other hand, a horizontal bifurcated arm 21 is projected from the rear portion of said armature 20 whereas a vertical bifurcated arm 22 is projected from the front portion of the same. At the back of the armature 20, there is projected from the upper face of the support bracket 16 a guide pin 23 which engages with the aforementioned horizontal bifurcated arm 21 to guide the projecting and retracting actions of the armature 20. When, moreover, the armature 20 of the aforementioned servo solenoid 18 is projected from a lower position, as indicated by solid lines in FIG. 2, the associative member 11 of the linkage means 12 is directly moved upward so that the presser bar 2 and the presser foot 4 are raised through the remaining members of the linkage means 12 and the bar connecting stud 3.

In front of the aforementioned armature 20, there is mounted through a mounting plate 25 on the upper face of the support bracket 16 overlying the servo solenoid 18 a potentiometer 24 acting as a movement detector, from whose righthand side there is projected an actuating shaft 26. On this actuating shaft 26, there is fixedly fitted the leg of a rotary lever 27, from whose leading-end lefthand side is projected a pin 27*a* made engageable with the vertical bifurcated arm 22 of said armature 20. When, moreover, the armature 20 of the aforementioned servo solenoid 18 is projected to raise the presser bar 2 and the presser foot 4, the actuating shaft 26 of the potentiometer 24 is rotated through the vertical bifurcated arm 22 and the rotary lever 27 in accordance with the projecting motion of the armature 20 so that a detection signal corresponding to the movement of said armature 20 is outputted from that potentiometer 24.

As shown in FIG. 1, there is arranged below the machine frame 1 an depressable control pedal 28 which constitutes switch means, needle-up stop signal generating means and needle-down stop signal generating means. From this control pedal 28, moreover, there is outputted a start signal for rotationally driving the aforementioned motor 15 at a speed corresponding to the extent of the depression of the control pedal 28 when a rear portion 28*a* thereof is depressed. When the control pedal 28 is returned to its neutral state after it has been depressed, there is outputted a needle-down stop signal for interrupting the rotations of the aforementioned motor 15 to stop the needle 14 at a bottom dead center below the needle plate. When the control pedal is then depressed back at its front portion 28*b*, there is outputted a needle-up stop signal for slightly rotating the motor 15 to cut the thread and for subsequently stopping the needle 14 at a top dead center above the needle plate to end the sewing operations.

As shown in FIG. 1, a control box 29 is arranged below the aforementioned machine frame 1. The control box 29 is equipped with a position setter 30 composed of a variable resistor or the like for vertically adjusting and presetting an intermediate position of the presser foot 4, which is to be moved up and down by the aforementioned servo solenoid 18, between an uppermost position, i.e., a releasing position and a lowermost position, i.e., a holding position in accordance with the thickness of the work fabric or the like when the work fabric is to be positioned exactly at the start of the sewing operations or to be turned in the course of the sewing operations. The control box 29 is further equipped with a time switch 31 constituting timer means for optionally by setting the time after the instant when the presser foot 4 is brought to the uppermost position on the basis of the action of the servo solenoid 18 at the end of the sewing operations and before the instant when the presser foot 4 is brought to the intermediate position set by the aforementioned position setter 30.

Figure 5:
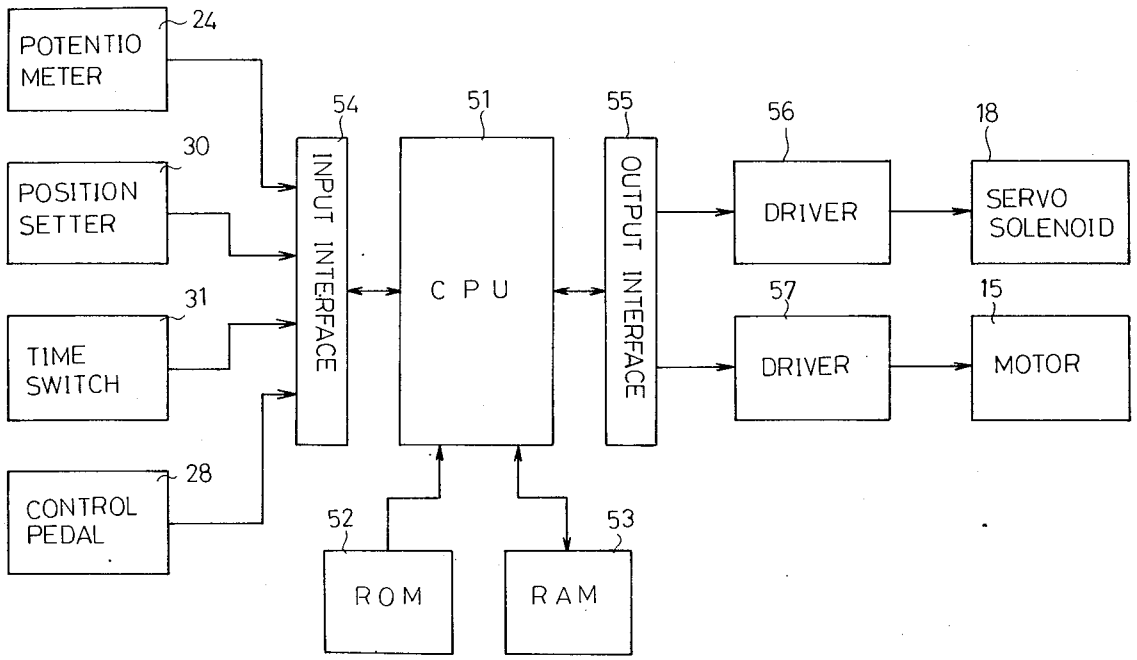
FIG. 5 is a block diagram showing the construction of a control circuit in the presser device for a sewing machine according to the present invention.

Next, in the sewing machine thus constructed, the construction of a control circuit for mainly controlling the operations of the servo solenoid 18 will be described with reference to FIG. 5. With a central processing unit (i.e., CPU) 51 constituting a control means, there are connected a read only memory (i.e., ROM) 52 and a random access memory (i.e., RAM) 53. The ROM 52 is stored with a program or the like for controlling the sewing machine as a whole whereas the RAM 53 is stored with the indication of the potentiometer 24 according to the movement of the armature 20 of the aforementioned servo solenoid 18, the energization of the servo solenoid 18 according to the set value of the position setter 30, and so on.

With the aforementioned CPU 51, moreover, there are connected through an input interface 54 the potentiometer 24, the position setter 30, the time switch 31 and the control pedal 28, from which the various signals are inputted to the CPU 51. Still moreover, the servo solenoid 18 and the motor 15 are connected with the CPU 51 through an output interface 55 and drivers 56 and 57 so that a drive or stop signal is outputted from the CPU 51 to the servo solenoid 18 and the motor 15. The CPU 51 controls the operation of the aforementioned servo solenoid 18 so as to move the presser foot 4 to the aforementioned intermediate position.

Next, the operations of the sewing machine thus constructed will be described in the following.

Figure 6:
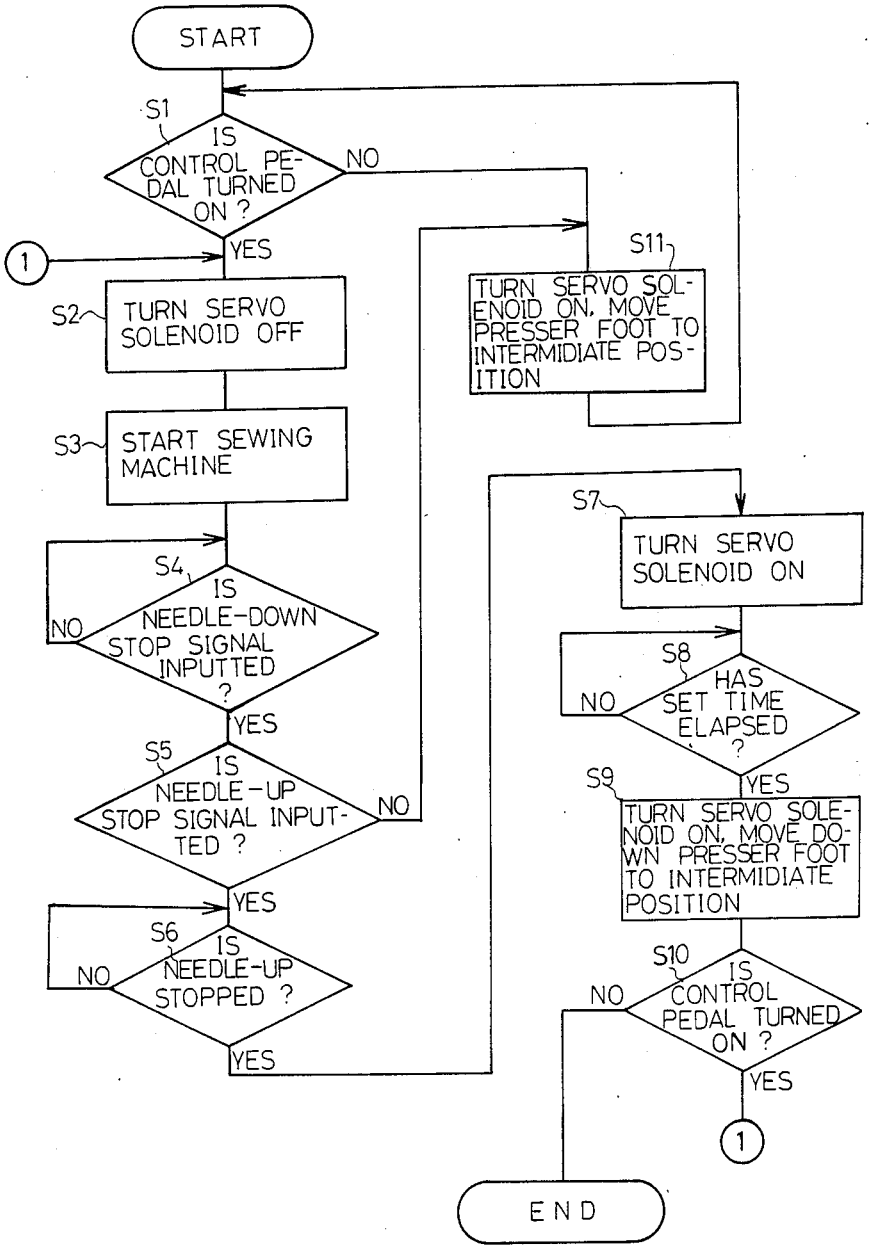
FIG. 6 is a flow chart showing the operations of the present invention in association with the sewing operations of the machine.

Here, in this sewing machine, for example, in the case of sewing a piece of fabric such as an emblem to the surface of the work fabric, such a program as is shown in the flow chart of FIG. 6 is started under the control of the CPU 51 when the power supply of the sewing machine is actuated. At first, the CPU 51 awaits the depression of the control pedal 28 at a step S1. When it is confirmed that the rear portion 28*a* of the control pedal 28 is depressed to input the start signal to the CPU 51, the program proceeds to a step S2. At this step S2, the presser bar 2 is moved down in response to deenergization of the servo solenoid 18 so that a predetermined pressure is applied to the work fabric by the presser foot 4. At a subsequent step S3, the motor 15 is started at an r.p.m. according to the depression of the aforementioned control pedal 28 to start the sewing operations of the sewing machine.

At a subsequent step S4, moreover, the needle-down stop signal from the control pedal 28 is awaited. When it is confirmed that the control pedal 28 is returned from its depressed state to a neutral position so that the needle-down stop signal is inputted to the CPU 51, the rotations of the motor 15 are interrupted to stop the needle 14 at the bottom dead center. Then, the program proceeds to a subsequent step S5. At this step S5, it is judged whether or not the needle-up stop signal has been inputted. If the needle-up stop signal is inputted to the CPU 51 on the basis of the depression of the front portion 28*b* of the aforementioned control pedal 28, the motor 15 is slightly rotated to cut the thread, followed by the movement of the needle 14 toward the top dead center. At a subsequent step S6, the needle-up stop is awaited. If it is confirmed that the needle 14 is stopped at the top dead center, the program proceeds to a subsequent step S7, at which the servo solenoid 18 is turned on so that the presser foot 4 is raised to the uppermost position to release the pressure imposed on the work fabric. As a result, it is possible to facilitate take-out of the work fabric in the state in which the presser foot 4 is arranged in the uppermost position.

At a subsequent step S8, it is judged whether or not the predetermined time set by the time switch 31 has elapsed after the presser foot 4 was raised to the uppermost position. Simultaneously with the lapse of that set time, the servo solenoid 18 is energized at a step S9 so that the presser foot 4 is moved down to the intermediate position according to the set value of the position setter 30. As a result, it is possible to facilitate exactly positioning of the work fabric for a subsequent sewing operation in the state in which that presser foot 4 is arranged in the predetermined intermediate position. At a subsequent step S10, it is then judged whether or not the depression pedal 28 is depressed. In case the depression pedal 28 is depressed to restart the sewing operations, the program returns from the step S10 to the foregoing step S2, at which the presser foot 4 is moved down to the lowermost position on the basis of the servo solenoid 18. In case, on the contrary, the depression pedal 28 is not depressed at the step S10, this non-depression is confirmed to end the run of the sewing machine.

On the other hand, in case the depression pedal 28 is not turned on at the start of the sewing operations of the foregoing step S1 so as to position the work fabric or in case another edge of the fabric piece such as the emblem is to be sewn by turning the work fabric or the fabric piece without cutting the thread after the needle-down stop in the judgement of the foregoing step S5, the program proceeds from those steps S1 and S5 to a subsequent step S11. At this step S11, the servo solenoid 18 is energized to move the presser foot 4 to the intermediate position according to the set value of the aforementioned position setter 30. After this, the program returns to the step S1 to await the depression of the control pedal 28. As a result, it is possible to facilitate the positioning or turning of the work fabric in the state in which that presser foot 4 is arranged in the predetermined intermediate position.

Incidentally, the present invention should not be limited to the construction of the embodiment thus far described but can be modified in various manners. For example, in the sewing machine of the type in which a sewing pattern is selected so that the sewing operations are carried out in accordance with the sewing pattern selected, the position setter 30 and the time switch 31 can be automatically set in a set value suitable for the sewing pattern selected.

Since widely different embodiments can apparently be constructed without departing from the spirit and scope of the present invention, the present invention should not be limited to its specified embodiment except that it is limited by the accompanying claims.

What is claimed is:

1. A presser device for a sewing machine, comprising:

pressing means reciprocally movable between a holding position in which it presses and holds a workpiece and a releasing position in which it is spaced the farthest from said workpiece;

drive means for driving said pressing means;

means for controlling said drive means so that said pressing means is brought into said holding position before the start of a sewing operation of said sewing machine;

means for controlling said drive means so that said pressing means is brought from said holding position to said releasing position after the end of said sewing operation;

timer means for setting a predetermined time from the instant when said pressing means is brought into said releasing position; and means for controlling said drive means so that said pressing means is brought from said releasing position to an optional intermediate position between said releasing position and said holding position after lapse of said predetermined time.

2. A presser device according to claim 1, further comprising setting means for setting the intermediate position of said pressing means in a vertically adjustable manner.

3. A presser device according to claim 1, wherein said timer means includes means for adjusting said predetermined time optionally.

4. A presser device according to claim 1, wherein said drive means including a servo solenoid and linkage means provided between said servo solenoid and pressing means.

5. A presser device according to claim 4, further comprising a control pedal for starting and stopping said sewing operation, said servo solenoid being actuated to move said pressing means from said releasing position to said intermediate position after lapse of said predetermined time set by said timer means at the instant when said sewing operation is stopped by operation of said control pedal.

* * * * *